US011688571B2

(12) United States Patent
Lilja et al.

(10) Patent No.: US 11,688,571 B2
(45) Date of Patent: Jun. 27, 2023

(54) ELECTRICAL SWITCH

(71) Applicant: ABB Schweiz AG, Baden (CH)

(72) Inventors: Juuso Lilja, Vaasa (FI); Jarmo Lehtimäki, Vaasa (FI)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/318,375

(22) Filed: May 12, 2021

(65) Prior Publication Data

US 2021/0375566 A1 Dec. 2, 2021

(30) Foreign Application Priority Data

May 28, 2020 (EP) ..... 20177074

(51) Int. Cl.
*H01H 1/14* (2006.01)
*H01H 33/02* (2006.01)
*H01H 33/04* (2006.01)

(52) U.S. Cl.
CPC ..... *H01H 33/04* (2013.01); *H01H 1/14* (2013.01); *H01H 33/025* (2013.01)

(58) Field of Classification Search
CPC .. H01H 33/04; H01H 33/025; H01H 33/7015; H01H 1/14; H01H 1/42; H01H 1/365; H01H 1/2041; H01H 1/06; H01H 1/36; H01H 1/40; H01H 9/52; H01H 19/52
USPC ..... 218/146, 20, 31, 32, 47, 48, 110, 134, 218/153, 154, 155; 200/244, 243, 303, 200/316, 50.34, 400
See application file for complete search history.

(56) References Cited

U.S. PATENT DOCUMENTS 8,604,377 B2 * 12/2013 Lee ..... H01H 1/22 218/149
9,123,481 B2 * 9/2015 Dahl ..... H01H 71/0214
9,437,376 B2 * 9/2016 Mattlar ..... H01H 9/362
9,478,373 B2 * 10/2016 Välivainio ..... H01H 9/342
9,508,495 B2 * 11/2016 Philip ..... H01H 1/2041
9,824,830 B2 * 11/2017 Ness ..... H01H 1/36
(Continued)

FOREIGN PATENT DOCUMENTS

EP 2447977 A1 5/2012
EP 2866242 A1 4/2015
EP 3561831 A1 10/2019

OTHER PUBLICATIONS

European Search Report; Application No. EP 20 17 7074; dated Nov. 10, 2020; 2 Pages.

*Primary Examiner* — William A Bolton
(74) *Attorney, Agent, or Firm* — Whitmyer IP Group LLC

(57) ABSTRACT

An electrical switch including a frame, a first stationary contact, a second stationary contact, a roll element and a movable contact mounted to the roll element. The roll element is rotatable around a rotation axis between a first position and a second position relative to the frame. The movable contact includes a first contact portion and a second contact portion. In the first position of the roll element, the movable contact electrically conductively connects the first stationary contact to the second stationary contact, and in the second position of the roll element the first stationary contact is electrically disconnected from the second stationary contact. The first in contact portion and the second contact portion are located on opposite sides of a centre plane perpendicular to the rotation axis.

19 Claims, 3 Drawing Sheets

(56) References Cited

U.S. PATENT DOCUMENTS

| | | | | |
|---|---|---|---|---|
| 2015/0200066 | A1* | 7/2015 | Legendre | H01H 33/86 218/47 |
| 2017/0301490 | A1* | 10/2017 | Domejean | H01H 33/182 |

* cited by examiner

Fig. 2a
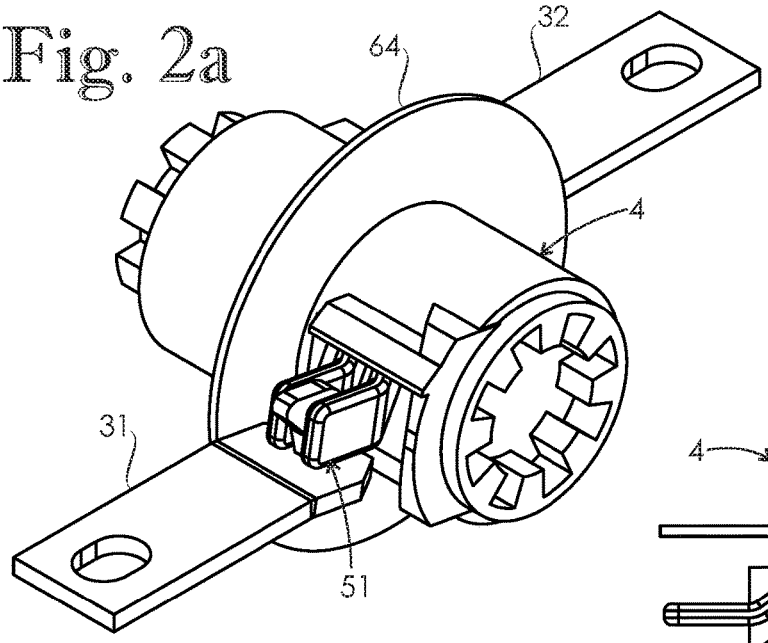
Fig. 2b
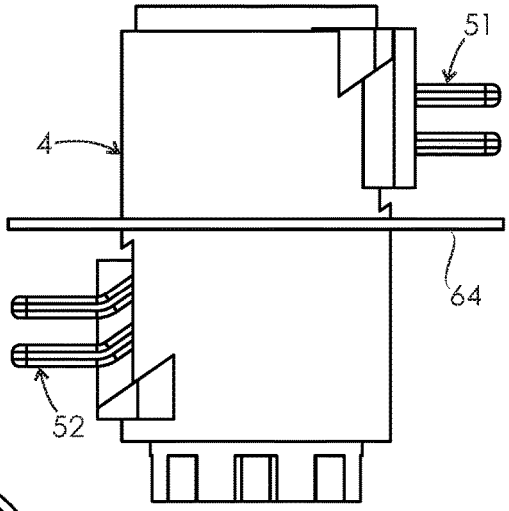
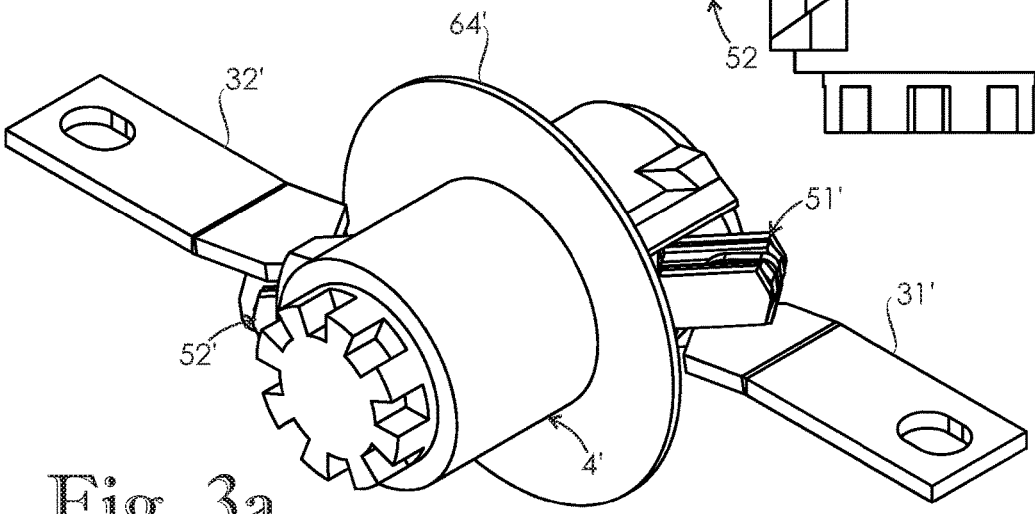
Fig. 3a
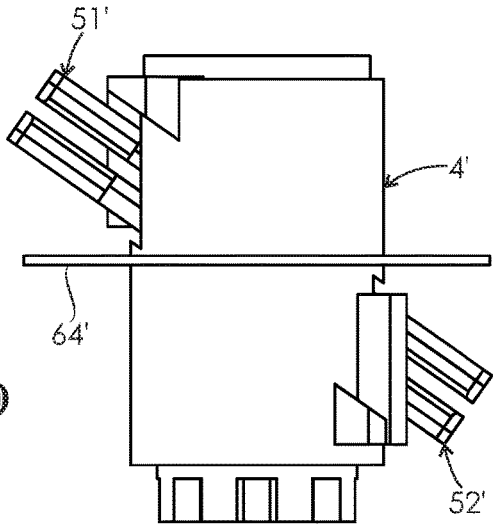
Fig. 3b

ELECTRICAL SWITCH

TECHNICAL FIELD

The present invention relates to electrical switches, and more particularly to extinguishing electric arcs in electrical switches.

BACKGROUND

During an opening event, an electric arc may be formed between a stationary contact and a movable contact moving away from the stationary contact. The electric arc conducts electricity so the electric arc must be extinguished in order to transfer the electrical switch to an OFF-state which is a non-conducting state. Further, electric arcs can be harmful for the electrical switch, especially if the electric arcs last long time and/or occur frequently.

One way to enhance extinguishing of electric arcs in an electrical switch is to increase clearance angle between a stationary contact and corresponding movable contact in an OFF-state of the electrical switch.

SUMMARY

An object of the present invention is to provide an electrical switch which is adapted to extinguish electric arcs more effectively than known electrical switches. The objects of the invention are achieved by an electrical switch which is characterized by what is stated in the independent claim. The preferred embodiments of the invention are disclosed in the dependent claims.

The invention is based on the idea of providing an electrical switch with a movable contact whose first contact portion and second contact portion are located on opposite sides of a centre plane perpendicular to a rotation axis of the movable contact, wherein the first contact portion is a portion adapted to be in contact with a first stationary contact of the electrical switch, and the second contact portion is a portion adapted to be in contact with a second stationary contact of the electrical switch.

An advantage of the electrical switch of the invention is a large clearance angle between each stationary contact and corresponding movable contact in an OFF-state of the electrical switch. The invention enables a clearance angle greater than 350° between each stationary contact and corresponding movable contact in an OFF-state of the electrical switch. In an embodiment, each of the contact portions of the movable contact is adapted to move pass an angular location of a stationary contact corresponding to the other contact portion.

BRIEF DESCRIPTION OF THE DRAWINGS

In the following the invention will be described in greater detail by means of preferred embodiments with reference to the attached drawings, in which

FIGS. 2*a* and 2*b* show a roll element and a movable contact of the electrical switch of FIG. 1;

FIGS. 3*a* and 3*b* show a roll element and a movable contact of an electrical switch according to another embodiment of the invention;

DETAILED DESCRIPTION

Figure 1:
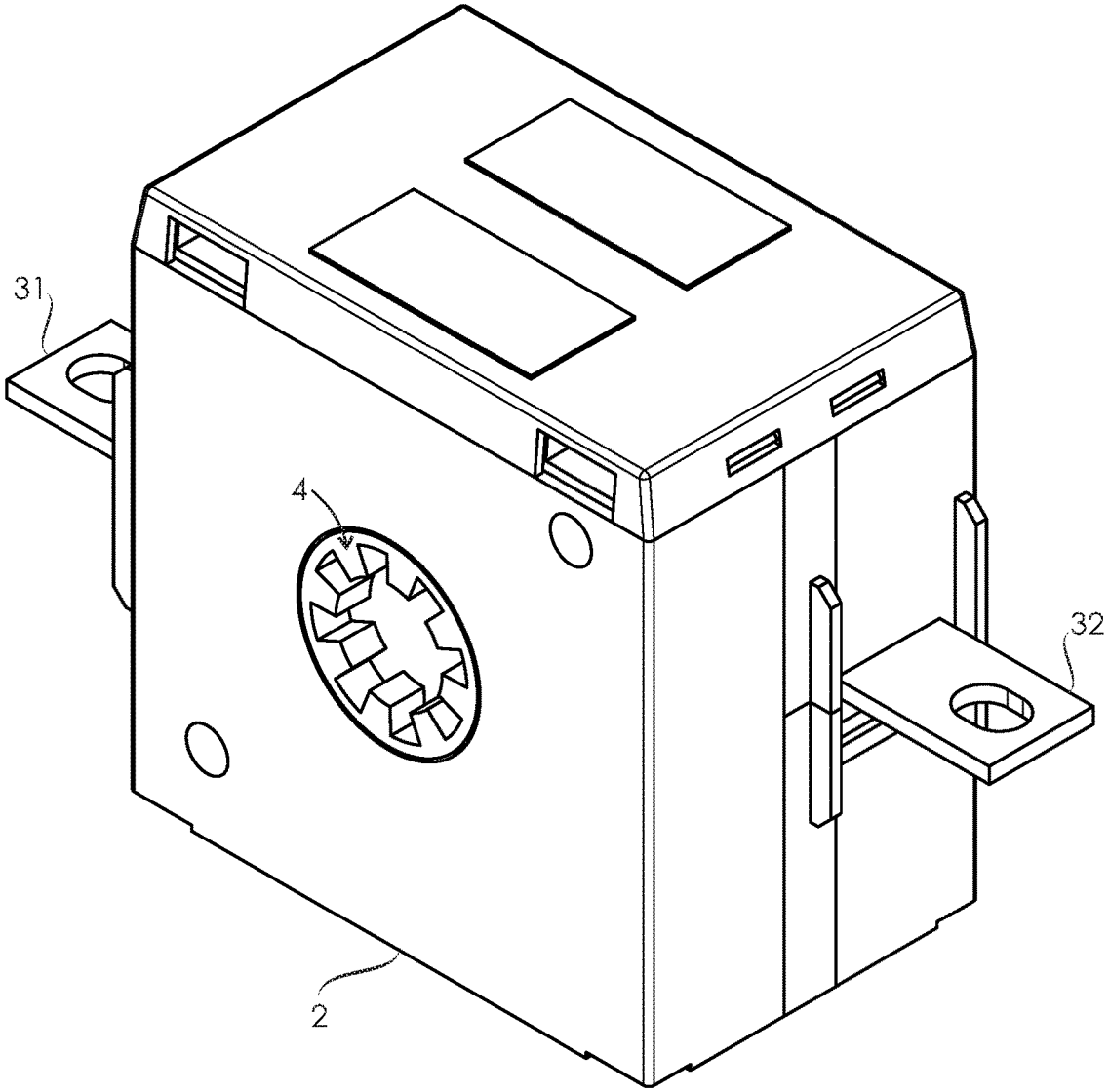
FIG. 1 shows an electrical switch according to an embodiment of the invention.
Figure 4A:
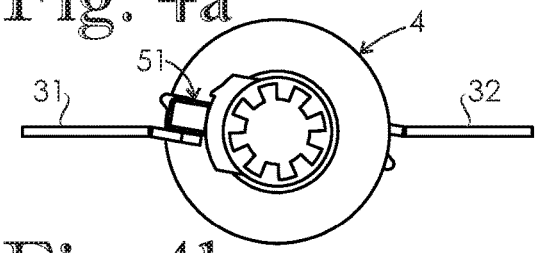
FIGS. 4*a* to 4*c* show the roll element of the electrical switch of FIG. 1 in different positions relative to a first stationary contact and second stationary contact.
Figure 4B:
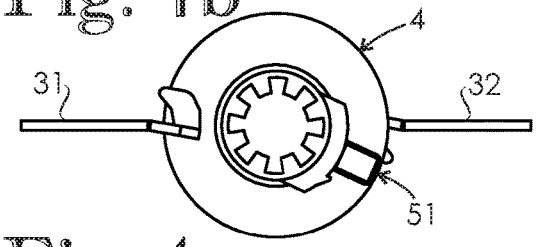
Figure 4C:
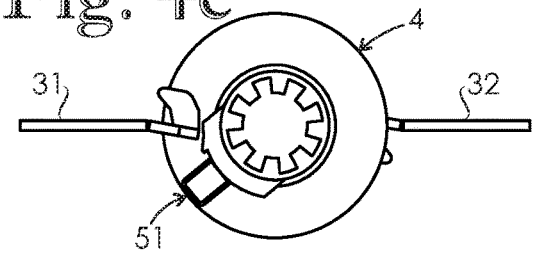
Figure 6:
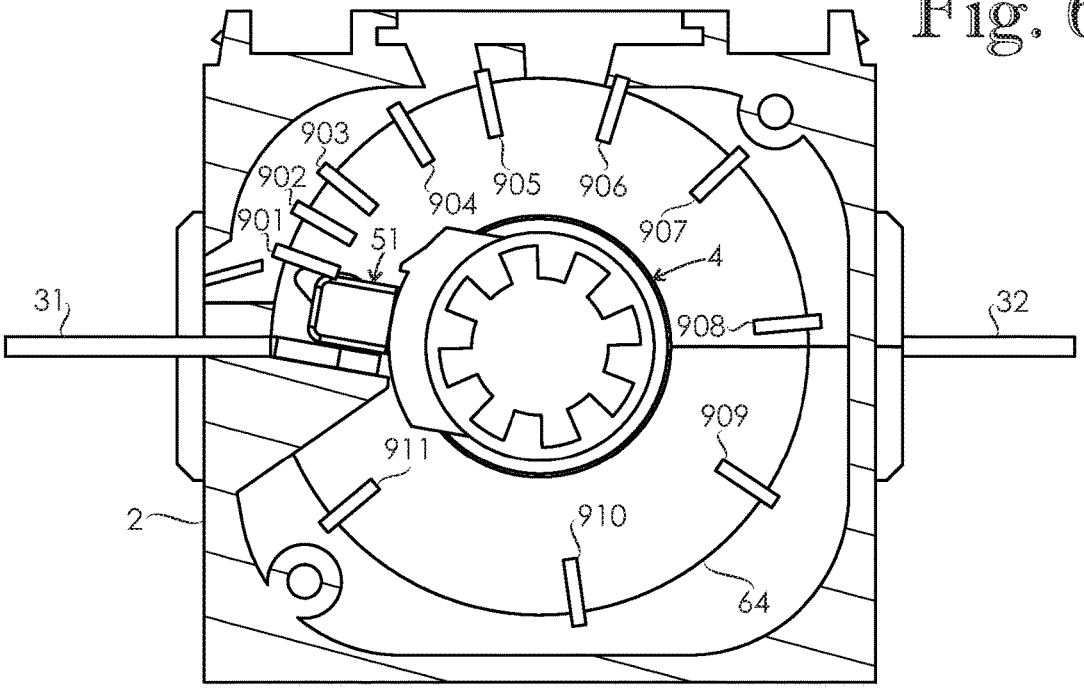
FIG. 6 shows a cross section of the electrical switch of FIG. 1 such that arc extinguisher plates corresponding to one breaking zone are visible.

FIG. 1 shows an electrical switch comprising a frame 2, a first stationary contact 31, a second stationary contact 32, a roll element 4, a movable contact, an arc extinguisher plate system and an isolator system. FIGS. 2*a* and 2*b* show internal structure of the electrical switch. FIGS. 4*a* to 4*c* show the roll element 4 in different positions relative to the first stationary contact 31 and the second stationary contact 32. FIG. 6 shows a cross section of the electrical switch of FIG. 1.

The first stationary contact 31 and second stationary contact 32 are made of electrically conductive material, and are stationary mounted relative to the frame 2. The roll element 4 is made of electrically insulating material, and is rotatable around a rotation axis between a first position and a second position relative to the frame 2. The roll element 4 is adapted to transfer from the first position to the second position in an opening event, and from the second position to the first position in a closing event.

The movable contact is mounted to the roll element 4, and comprises a first contact portion 51 and a second contact portion 52. The movable contact is stationary relative to the roll element 4. The movable contact is made of electrically conducting material such that the first contact portion 51 and the second contact portion 52 are electrically conductively connected.

The first contact portion 51 and the second contact portion 52 are located on opposite sides of a centre plane perpendicular to the rotation axis. The centre plane is an imaginary plane. A distance between a free end of the first contact portion 51 and a free end of the second contact portion 52 in a direction parallel to the rotation axis is less than a distance between the free end of the first contact portion 51 and the free end of the second contact portion 52 in a direction perpendicular to the rotation axis.

In the first position of the roll element 4, the first contact portion 51 is in contact with the first stationary contact 31, and the second contact portion 52 is in contact with the second stationary contact 32 such that the movable contact electrically conductively connects the first stationary contact 31 to the second stationary contact 32. In the second position of the roll element 4, the first contact portion 51 is at a distance from the first stationary contact 31, and the second contact portion 52 is at a distance from the second stationary contact 32 such that the first stationary contact 31 is electrically disconnected from the second stationary contact 32. Consequently, the opening event is adapted for transferring the electrical switch from an ON-state to an OFF-state, and the closing event is adapted for transferring the electrical switch from the OFF-state to the ON-state.

Referring to FIG. 2*b*, the first contact portion 51 and the second contact portion 52 extend in direction parallel to the centre plane, and they are coupled to each other with a middle portion extending in approximately 35° angle relative to the centre plane. FIGS. 3*a* and 3*b* show a roll element and a movable contact of an electrical switch according to an alternative embodiment, in which the movable contact extends linearly through the roll element 4', and the first contact portion 51' and the second contact portion 52' extend in approximately 35° angle relative to the centre plane. The movable contact has a flexible structure allowing the first contact portion 51' and the second contact portion 52' to bend in order to connect to and from corresponding stationary contacts.

An angular distance between the first stationary contact 31 and the second stationary contact 32 is 180°. The angular distance between the first stationary contact 31 and the second stationary contact 32 is an angle between a first vector from the rotation axis to the first stationary contact 31, and a second vector from the rotation axis to the second stationary contact 32. The first vector and second vector are perpendicular to the rotation axis, and the angular distance is measured on a plane perpendicular to the rotation axis.

A rotation angle between the first position and the second position of the roll element 4 is 310°. In an OFF-state of the electrical switch, a clearance angle between the first stationary contact 31 and the first contact portion 51 is 310°, and a clearance angle between the second stationary contact 32 and the second contact portion 52 is also 310°. Consequently, a total clearance angle of the electrical switch is 620°. During the opening event, the first contact portion 51 is adapted to move pass an angular location of the second stationary contact 32, and the second contact portion 52 is adapted to move pass an angular location of the first stationary contact 31. Herein, an angular location of a component is a location of a projection of the component on the centre plane. In an alternative embodiment, a total clearance angle of the electrical switch is less than or equal to 710°.

An angular distance between the first stationary contact and the second stationary contact can be selected quite freely, such that the angular distance can be 90°, 180°, 225° or 360°, for example. Irrespective of an angular distance between the first stationary contact and the second stationary contact, a rotation angle between the first position and the second position of the roll element can be designed to be close to 360°. It should be noted that in embodiments where an angular distance between the first stationary contact and the second stationary contact is 360°, the first contact portion is not adapted to move pass an angular location of the second stationary contact during the opening event, and the second contact portion is not adapted to move pass an angular location of the first stationary contact during the opening event.

Due to structures of the first stationary contact 31 and second stationary contact 32, the roll element 4 is adapted to rotate in a first direction during the opening event, and in a second direction during the closing event, wherein the first direction and the second direction are opposite directions. In an alternative embodiment, the roll element is adapted to rotate in the same direction both during the opening event, and during the closing event. If such a unidirectional design is used, a rotation angle relating to the closing event is a difference between 360° and a rotation angle relating to the opening event. For example, if a rotation angle relating to the opening event is 355°, then a rotation angle relating to the closing event is 5°.

There is a first breaking zone between the first stationary contact 31 and the second position of the first contact portion 51, and a second breaking zone between the second stationary contact 32 and the second position of the second contact portion 52. An angular dimension of each of the first breaking zone and the second breaking zone is equal to the rotation angle between the first position and the second position of the roll element.

If prior to an opening event there is an electric current between the first stationary contact 31 and the second stationary contact 32, then in a beginning of the opening event a first electric arc is generated between the first stationary contact 31 and the first contact portion 51, and a second electric arc is generated between the second stationary contact 32 and the second contact portion 52. During the opening event, the first electric arc need to be extinguished in the first breaking zone, and the second electric arc need to be extinguished in the second breaking zone.

The arc extinguisher plate system is adapted to enhance extinguishing of electric arcs during the opening events. The arc extinguisher plate system comprises a plurality of first arc extinguisher plates 901-911 in the first breaking zone, and a plurality of second arc extinguisher plates in the second breaking zone. Each of the first arc extinguisher plates 901-911 and second arc extinguisher plates is a generally U-shaped element made of electrically conducting material. The first breaking zone and the first arc extinguisher plates 901-911 can be seen in FIG. 6.

Each arc extinguisher plate is electrically isolated from the other arc extinguisher plates of the arc extinguisher plate system. During the opening event the first contact portion 51 of the movable contact is adapted to pass between the lateral branches of the first arc extinguisher plates, and the second contact portion 52 of the movable contact is adapted to pass between the lateral branches of the second arc extinguisher plates. Arc extinguisher plates as such are well known in the art, and therefore they are not discussed in detail herein.

Mutual angular distance between consecutive first arc extinguisher plates increases as a function of angular distance from the first stationary contact 31, and mutual angular distance between consecutive second arc extinguisher plates increases as a function of angular distance from the second stationary contact 32. Referring to FIG. 6, angular distance between first arc extinguisher plates 901 and 902 is much smaller than angular distance between first arc extinguisher plates 910 and 911.

In an alternative embodiment, the first arc extinguisher plates are situated in following angular locations relative to the first stationary contact: 5°, 10°, 20°, 40°, 80°, 130°, 190°, 260°, 340°, and the second arc extinguisher plates are situated in corresponding angular locations relative to the second stationary contact. An arc extinguisher plate system provided with increasing mutual angular distance between consecutive arc extinguisher plates is especially practicable in connection with electrical switches whose total clearance angle is greater than or equal to 360°.

In another alternative embodiment, the arc extinguisher plate system comprises a plurality of arc extinguisher plates in a breaking zone such that an angular distance between a third and a second of the plurality of arc extinguisher plates is at least 50% larger than an angular distance between the second and a first of the plurality of arc extinguisher plates, and an angular distance between the last and the second last of the plurality of arc extinguisher plates is at least 45°. A sequence numbering of the plurality of arc extinguisher plates in the breaking zone is started from the arc extinguisher plate pass which a corresponding contact portion of the movable contact first moves during the opening event.

In a further alternative embodiment, the arc extinguisher plate system comprises a plurality of arc extinguisher plates, and mutual angular distance between consecutive first arc extinguisher plates is constant, and mutual angular distance between consecutive second arc extinguisher plates is constant. In other words, the arc extinguisher plates can be arranged the same way as in prior art electrical switches.

The isolator system electrically isolates the first breaking zone from the second breaking zone. The isolator system is adapted to prevent transfer of electrical arcs from one side of the isolator system to the other during the opening event of the electrical switch. For example, when the first contact portion 51 moves pass the angular location of the second stationary contact 32, the isolator system prevents transfer of an electrical arc from the first contact portion 51 to the second stationary contact 32, which transfer of the electrical arc would be harmful since it would stop the electrical switch from transferring to a non-conducting state.

The centre plane passes through the isolator system. A projection of the isolator system on the centre plane has an area larger than a circle whose diameter is equal to a distance between a free end of the first contact portion 51 and a free end of the second contact portion 52.

The isolator system comprises an isolator portion of the frame, and an isolator portion 64 of the roll element, both made of electrically insulating material. The isolator portion of the frame is not shown in the Figures. A projection of the isolator portion 64 of the roll element partially overlap with a projection of the isolator portion of the frame on the centre plane, thereby ensuring that there is no route for an electric arc in a junction between the isolator portion of the frame and the isolator portion 64 of the roll element.

The first contact portion 51 and second contact portion 52 are adapted to operate as knife contacts. This means that in the first position of the roll element 4, an electric current is adapted to flow between the first stationary contact 31 and the first contact portion 51, and between the second stationary contact 32 and the second contact portion 52 generally in a direction parallel to the rotation axis. In an alternative embodiment, the first contact portion and second contact portion are adapted to operate as bumper contacts, wherein in the first position of the roll element, an electric current is adapted to flow between the first stationary contact and the first contact portion, and between the second stationary contact and the second contact portion generally in a direction perpendicular to the rotation axis.

FIGS. 4*a* to 4*c* illustrate different positions of the roll element 4 during the opening event. In FIG. 4*a*, the roll element 4 is in the first position. In FIG. 4*c*, the roll element 4 is in the second position. In FIG. 4*b*, the roll element 4 has rotated clockwise to a position between the first position and the second position, and the first contact portion 51 has just passed an angular location of the second stationary contact 32. In FIGS. 4*a* to 4*c*, the rotation axis perpendicular to the image plane.

Figure 5A:
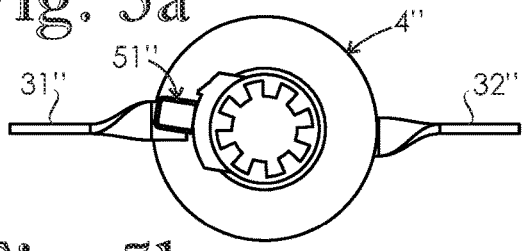
FIGS. 5*a* to 5*c* show a roll element of an electrical switch according to yet another embodiment of the invention in different positions relative to a first stationary contact and second stationary contact.
Figure 5B:
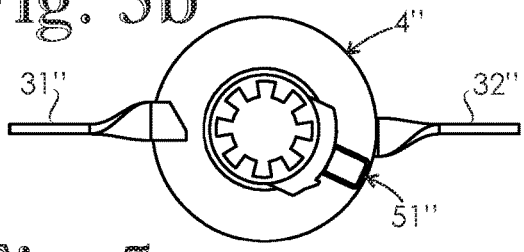
Figure 5C:
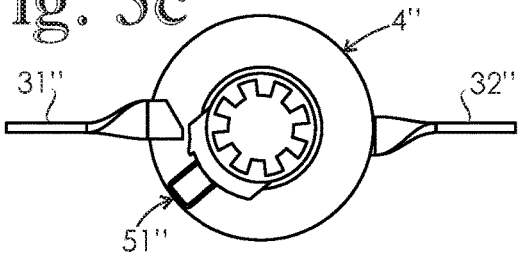

FIGS. 5*a* to 5*c* show a roll element 4" of an electrical switch according to yet another embodiment of the invention in positions corresponding to FIGS. 4*a* to 4*c*. The electrical switch of FIGS. 5*a* to 5*c* has the unidirectional design discussed above. Consequently, a transfer from the second position shown in FIG. 5*c* to the first position shown in FIG. 5*a* is realized by rotating the roll element 4" clockwise. Contact surfaces of the first stationary contact 31" and the second stationary contact 32" are planar surfaces which are in small angle relative to the centre plane, thereby allowing the first contact portion 51" to rotate over the angular location of the first stationary contact 31", and the second contact portion to rotate over the angular location of the second stationary contact 32". A contact surface of the first stationary contact 31" is a surface adapted to be in contact with the first contact portion 51" in the first position of the roll element 4", and a contact surface of the second stationary contact 32" is a surface adapted to be in contact with the second contact portion in the first position of the roll element 4".

It will be obvious to a person skilled in the art that the inventive concept can be implemented in various ways. The invention and its embodiments are not limited to the examples described above but may vary within the scope of the claims.

The invention claimed is:

1. An electrical switch comprising:

a frame;

a first stationary contact stationary mounted relative to the frame;

a second stationary contact stationary mounted relative to the frame;

a roll element rotatable around a rotation axis between a first position and a second position relative to the frame, wherein the roll element is adapted to transfer from the first position to the second position in an opening event; and a movable contact mounted to the roll element, and including a first contact portion and a second contact portion, wherein in the first position of the roll element the first contact portion is in a first position of the first contact portion in which the first contact portion is in contact with the first stationary contact, and the second contact portion is in a first position of the second contact portion in which the second contact portion is in contact with the second stationary contact such that the movable contact electrically conductively connects the first stationary contact to the second stationary contact, and in the second position of the roll element the first contact portion and second contact portion are in their respective second positions such that the first stationary contact is electrically disconnected from the second stationary contact, wherein there is a first breaking zone between the first stationary contact and the second position of the first contact portion, and a second breaking zone between the second stationary contact and the second position of the second contact portion, wherein the first contact portion and the second contact portion are located on opposite sides of a center plane perpendicular to the rotation axis, wherein the movable contact is made of electrically conducting material such that the first contact portion and the second contact portion are electrically conductively connected, wherein the electrical switch comprises an isolator system electrically isolating the first breaking zone from the second breaking zone, the center plane passing through the isolator system, wherein the isolator system is adapted to prevent transfer of electrical arcs from one side of the isolator system to the other during the opening event of the electrical switch.

2. The electrical switch as claimed in claim 1, wherein the isolator system comprises an isolator portion of the frame.

3. The electrical switch as claimed in claim 2, wherein the isolator system comprises an isolator portion of the roll element.

4. The electrical switch as claimed in claim 1, wherein the isolator system comprises an isolator portion of the roll element.

5. The electrical switch as claimed in claim 1 wherein the electrical switch comprises an arc extinguisher plate system for extinguishing electric arcs during the opening events, the arc extinguisher plate system including a plurality of first arc extinguisher plates in the first breaking zone, and a plurality of second arc extinguisher plates in the second breaking zone.

6. The electrical switch as claimed in claim 5, wherein mutual angular distance between consecutive first arc extinguisher plates increases as a function of angular distance from the first stationary contact, and mutual angular distance between consecutive second arc extinguisher plates increases as a function of angular distance from the second stationary contact.

7. The electrical switch as claimed in claim 6, wherein each of the plurality of first arc extinguisher plates is a generally U-shaped element positioned such that during the opening event the first contact portion of the movable contact is adapted to pass between lateral branches of the first arc extinguisher plate, and each of the plurality of second arc extinguisher plates is a generally U-shaped element positioned such that during the opening event the second contact portion of the movable contact is adapted to pass between lateral branches of the second arc extinguisher plate.

8. The electrical switch as claimed in claim 5, wherein each of the plurality of first arc extinguisher plates is a generally U-shaped element positioned such that during the opening event the first contact portion of the movable contact is adapted to pass between lateral branches of the first arc extinguisher plate, and each of the plurality of second arc extinguisher plates is a generally U-shaped element positioned such that during the opening event the second contact portion of the movable contact is adapted to pass between lateral branches of the second arc extinguisher plate.

9. The electrical switch as claimed in claim 1, wherein a distance between a free end of the first contact portion and a free end of the second contact portion in a direction parallel to the rotation axis is less than a distance between the free end of the first contact portion and the free end of the second contact portion in a direction perpendicular to the rotation axis.

10. The electrical switch as claimed in claim 1, wherein the first contact portion and second contact portion are adapted to operate as knife contacts.

11. The electrical switch as claimed in claim 1, wherein a rotation angle between the first position and the second position of the roll element is greater than or equal to 180°.

12. The electrical switch as claimed in claim 11, wherein the rotation angle between the first position and the second position of the roll element is greater than or equal to 300°.

13. The electrical switch as claimed in claim 1, wherein during the opening event the first contact portion is adapted to move pass an angular location of the second stationary contact, and the second contact portion is adapted to move pass an angular location of the first stationary contact.

14. The electrical switch as claimed in claim 1, wherein a projection of the isolator system on the center plane has an area larger than a circle whose diameter is equal to a distance between a free end of the first contact portion and a free end of the second contact portion.

15. The electrical switch as claimed in claim 1, wherein a projection of an outline of the isolator system delimits on the center plane an area larger than a circle whose diameter is equal to a distance between a free end of the first contact portion and a free end of the second contact portion.

16. The electrical switch as claimed in claim 1, wherein the isolator system comprises an isolator portion of the frame, and an isolator portion of the roll element, wherein a projection of the isolator portion of the roll element partially overlap with a projection of the isolator portion of the frame on the center plane, thereby ensuring that there is no route for an electric arc in a junction between the isolator portion of the frame and the isolator portion of the roll element.

17. An electrical switch comprising:

a frame;

a first stationary contact stationary mounted relative to the frame;

a second stationary contact stationary mounted relative to the frame;

a roll element rotatable around a rotation axis between a first position and a second position relative to the frame, wherein the roll element is adapted to transfer from the first position to the second position in an opening event; and a movable contact mounted to the roll element, and including a first contact portion and a second contact portion, wherein in the first position of the roll element the first contact portion is in a first position of the first contact portion in which the first contact portion is in contact with the first stationary contact, and the second contact portion is in a first position of the second contact portion in which the second contact portion is in contact with the second stationary contact such that the movable contact electrically conductively connects the first stationary contact to the second stationary contact, and in the second position of the roll element the first contact portion and second contact portion are in their respective second positions such that the first stationary contact is electrically disconnected from the second stationary contact, wherein there is a first breaking zone between the first stationary contact and the second position of the first contact portion, and a second breaking zone between the second stationary contact and the second position of the second contact portion, wherein the first contact portion and the second contact portion are located on opposite sides of a center plane perpendicular to the rotation axis, and wherein a rotation angle between the first position and the second position of the roll element is greater than or equal to 180°.

18. The electrical switch as claimed in claim 17, wherein the rotation angle between the first position and the second position of the roll element is greater than or equal to 300°.

19. An electrical switch comprising:

a frame;

a first stationary contact stationary mounted relative to the frame;

a second stationary contact stationary mounted relative to the frame;

a roll element rotatable around a rotation axis between a first position and a second position relative to the frame, wherein the roll element is adapted to transfer from the first position to the second position in an opening event; and a movable contact mounted to the roll element, and including a first contact portion and a second contact portion, wherein in the first position of the roll element the first contact portion is in a first position of the first contact portion in which the first contact portion is in contact with the first stationary contact, and the second contact portion is in a first position of the second contact portion in which the second contact portion is in contact with the second stationary contact such that the movable contact electrically conductively connects the first stationary contact to the second stationary contact, and in the second position of the roll element the first contact portion and second contact portion are in their respective second positions such that the first stationary contact is electrically disconnected from the second stationary contact, wherein there is a first breaking zone between the first stationary contact and the second position of the first contact portion, and a second breaking zone between the second stationary contact and the second position of the second contact portion, wherein the first contact portion and the second contact portion are located on opposite sides of a center plane perpendicular to the rotation axis, wherein the electrical switch comprises an isolator system electrically isolating the first breaking zone from the second breaking zone, the center plane passing through the isolator system, and wherein a projection of an outline of the isolator system delimits on the center plane an area larger than a circle whose diameter is equal to a distance between a free end of the first contact portion and a free end of the second contact portion.

* * * * *